US005729880A

United States Patent [19]

Ko

[11] Patent Number: 5,729,880

[45] Date of Patent: Mar. 24, 1998

[54] ADJUSTABLE TYPE HAND RIVET NUT TOOL WITH QUICK-CHANGE MANDREL

[76] Inventor: Yung-Chang Ko, 7th Fl., No. 21, Sec. 3, Minsheng E. Rd., Taipei, Taiwan

[21] Appl. No.: 838,139

[22] Filed: Apr. 15, 1997

[30] Foreign Application Priority Data

Jun. 6, 1996 [TW] Taiwan ..... 85208490

[51] Int. Cl.[6] ..... B21J 15/38

[52] U.S. Cl. ..... 29/243.521; 29/243.528; 72/391.8; 72/114

[58] Field of Search ..... 29/243.521, 234.526, 29/243.527, 243.528; 72/114, 391.8; 227/55

[56] References Cited

U.S. PATENT DOCUMENTS

| | | | |
|---|---|---|---|
| 2,324,104 | 7/1943 | Moss | 72/391.8 |
| 3,328,985 | 7/1967 | Keymer | 29/243.528 |
| 3,886,782 | 6/1975 | Miyamoto | 29/243.528 |
| 4,140,000 | 2/1979 | Ehmann | 72/114 |
| 4,192,163 | 3/1980 | Martin | 72/114 |
| 4,425,782 | 1/1984 | Todisco | 72/114 |
| 5,050,420 | 9/1991 | Liu | 29/243.521 |

FOREIGN PATENT DOCUMENTS 130757 5/1978 Germany .

*Primary Examiner*—David Jones

*Attorney, Agent, or Firm*—Burns, Doane, Swecker & Mathis, LLP

[57] ABSTRACT

A rivet nut tool includes a lower handle defining a body and an upper handle pivotably connected thereto. A nosepiece is attached to the body. A collet case is mounted in the body and fixedly connected with the upper handle. An adjusting collar threadedly engages with the collet case and defines an adjusting knob. A lock nut threadedly engages with the adjusting collar and locates between the adjusting knob and the body. A mandrel is connected with the adjusting collar and extends through the adjusting collar, the collet case and the nosepiece. The mandrel defines a threaded portion protruding from the nosepiece and a mandrel knob distal to the threaded portion and in contact with the adjusting knob. The mandrel is so connected with the adjusting collar that it is rotatable relative to the adjusting collar and when a large pulling force is exerted on the mandrel knob, the connection between the mandrel and the adjusting collar will be released. The mandrel is so connected with the adjusting collar that it makes the length of threaded portion of mandrel adjustable to be the same length as that of rivet nut, and the lock nut engaged with the adjusting collar can lock the positions of the adjusting collar and the mandrel.

7 Claims, 7 Drawing Sheets

ADJUSTABLE TYPE HAND RIVET NUT TOOL WITH QUICK-CHANGE MANDREL

FIELD OF THE INVENTION

The present invention is related to a hand rivet nut tool, particularly to a hand rivet nut tool with a mandrel whose position is adjustable and which is able to be easily and quickly changed.

BACKGROUND OF THE INVENTION

A hand rivet nut tool is a tool designed for deforming a rivet nut which has sufficient inner threading to build up secure threading in a thin base metal or pipe with one work Side. The thin base metal or pipe therefore can be firmly fastened with a bolt or screw.

FIG. 7 shows a conventional hand rivet nut tool 90. The tool 90 includes a lower handle 98 and an upper handle 95 pivotably connected to the lower handle 98. A collet case 92 is fixedly attached to an upper end of a left side of the lower handle 98. A mandrel 93 is mounted inside the collet case 92. The mandrel 93 defines a rear threaded portion 931 connected with a rotary shaft 921 which in turn is drivably connected with the upper handle 95, whereby when the upper handle 95 has a pivotable movement relative to the lower handle 98, the mandrel 93 can have a linear movement in the collet case 92.

The mandrel 93 further defines a front threaded portion 932 which is used to extend through a nosepiece 94 to threadedly engage with a rivet nut (not shown). The nosepiece 94 is threadedly connected with the collet case 92.

A stroke-adjusting bolt 96 is extended firstly through a stroke lock-nut 97 and then the upper handle 95. By rotating the bolt 96, which causes that the bolt 96 moves toward or away from the lower handle 98, the pivotable distance of the upper handle 95 relative to the lower handle 98 can be set, whereby the stroke of the mandrel 93 is set accordingly.

When the conventional hand rivet nut tool 90 is used to build up secure threading in the thin base metal or pipe, a rivet nut which has inner threading is brought to threadedly engage with the front threaded portion 932 of the mandrel 93. Thereafter, the rivet nut is brought to extend through a hole of the thin base metal or pipe. Subsequently, a pushing force is exerted on the upper handle 95 to make it move toward the lower handle 98, whereby the mandrel 93 is moved to the right of FIG. 7 to exert a compressing force on the rivet nut 30 and the thin base metal or pipe to be fastened until the rivet nut 30 is suitably deformed whereby the secure threading are built up in the thin base metal or pipe. Finally, the mandrel 93 is rotated until the threaded engagement between the front threaded portion 932 and the rivet nut is released.

Such a conventional hand rivet nut tool 90 has the following disadvantages.

Firstly, due to the facts that the position of the mandrel 93 is not adjustable and the front threaded portion 932 may protrude from the nosepiece 94 a too-long or too-short distance, the following problem is often encountered with the prior art hand rivet nut tool 90: if the front threaded portion 932 protrudes from the nosepiece 94 a too-long distance, a longer time is taken for the rivet nut to be screwed onto the front threaded portion 932 to reach the required position for the fastening operation. Alternatively, if the front threaded portion 932 protrudes from the nosepiece 94 a too short distance, there will be an insufficient amount of threading of the front threaded portion 932 engaging with the threaded portion of the rivet nut. If this happens, when the fastening operation is performed, fracture of the threading of the threaded portion of the rivet nut may occur.

Secondly, since a specially designed wrench is needed to rotate the mandrel 93 to mount it in an end of the rotary shaft 921 or to remove it therefrom, it is laborious and troublesome to change the mandrel 93 to meet different thread sizes of different rivet nuts.

The present invention therefore is aimed to provide an improved adjustable type hand rivet nut tool with quick-change mandrel to mitigate and/or obviate the aforementioned problems.

SUMMARY OF THE INVENTION

An objective of the present invention is to provide a hand rivet nut tool with a mandrel whose position is adjustable so that the length of a threaded portion of the mandrel protruding from a nosepiece is also adjustable to meet different lengths of inner threading of different rivet nuts.

Another objective of the present invention is to provide a hand rivet nut tool with a mandrel being able to be quickly and easily changed.

The other objective of the present invention is to provide a hand rivet nut tool with a great advantage of one-time adjustment which can repeat the many fastening operations of the same size of rivet nut without any further adjustment.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
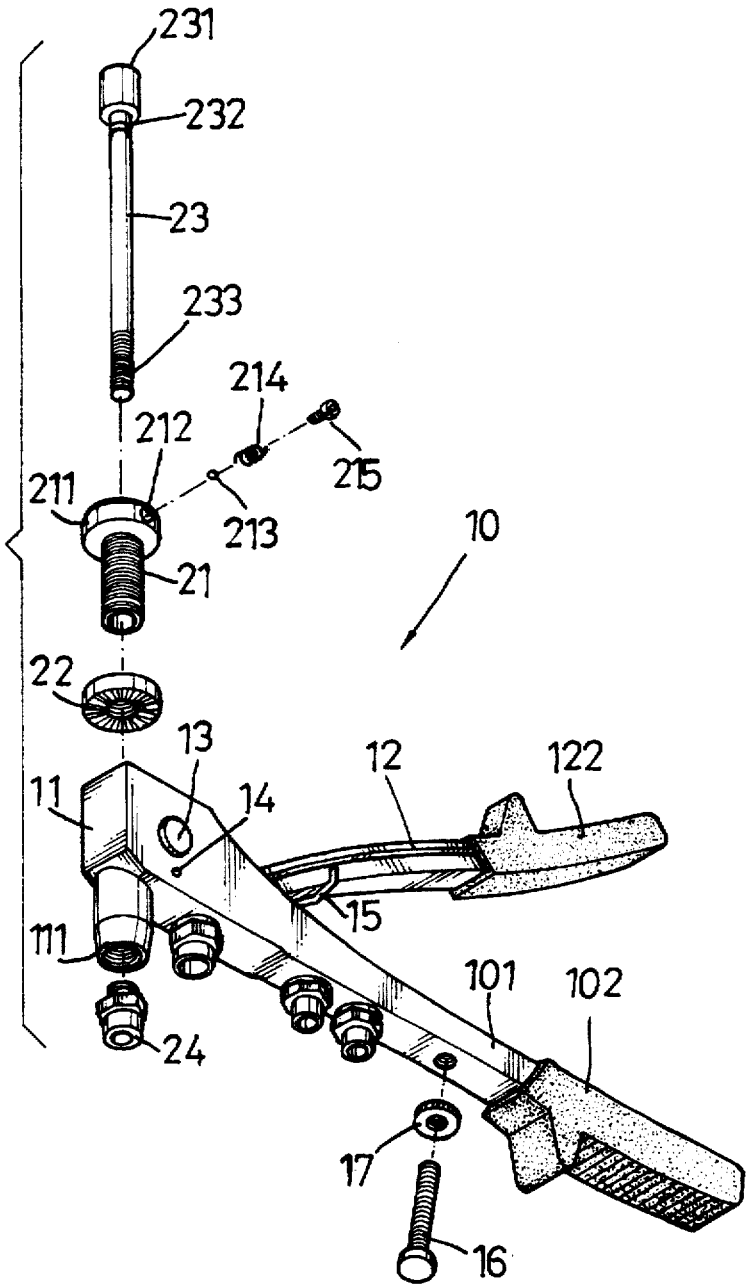
FIG. 1 is a left-front-bottom perspective, exploded view showing a hand rivet nut tool in accordance with the present invention.

Referring to FIGS. 1 to 4, a hand rivet nut tool 10 generally includes a lower handle 101, an upper handle 12 pivotably connected to the lower handle 101, a body 11 made of a suitable material, for example, aluminum, being formed at a top of the lower handle 101, a protrusion 111 being integrally formed on a lower side of the body 11, a nosepiece 24 attached to the protrusion 111 by a threaded engagement, a collet case 20 which defines inner threading and being slideably mounted in the body 11, an adjusting collar 21 which defines outer threading having a first portion extending into the body 11 to threadedly engage with the collet case 20 and a second portion extending out of the body 11 and threadedly engaging with a lock nut 22, a mandrel 23 being extended through the adjusting collar 21, the collet case 20 and the nosepiece 24.

Both the upper and lower handles 12 and 101 respectively define gripping portions 122 and 102 at a bottom thereof (FIG. 1), whereby an operator can use one hand to grip the handles 12 and 101 to exert a pushing force on the upper handle 12 directed toward the lower handle 101.

Several (three) spare nosepieces (not labeled) with different configurations for engaging different sizes of different rivet nuts are attached to a left side of the lower handle 101 of FIG. 1.

A stroke-adjusting bolt 16 is used to extend through a stroke lock-nut 17 and then a lower part of the lower handle 101, wherein the bolt 16 is threadedly engaged with the stroke lock nut 17 and the lower handle 101. As better seen in FIG. 4, the bolt 16 is used to set the pivotable distance between the lower handle 101 and the upper handle 12 thereby to set the stroke of the mandrel 23. By rotating the bolt 16 toward the upper handle 12, the stroke of the mandrel 23 is shortened. Alternatively, by rotating the bolt 16 away from the upper handle 12, the stroke of the mandrel 23 is lengthened.

The upper handle 12 is pivotably connected to the lower handle 101 via a fulcrum pin 13 which is fixedly extended through the body 11. A torsion spring pin 14 is also fixedly extended through the body 11 and located near the fulcrum pin 13. A torsion spring 15 is mounted on the torsion spring pin 14 and has a first arm fastened to the body 11 and a second arm fastened to the upper handle 12. By the provision of the torsion spring 15, when a pushing force on the upper handle 12 toward the lower handle 101 is released, the upper handle 12 can automatically return to its original position.

Figure 2:
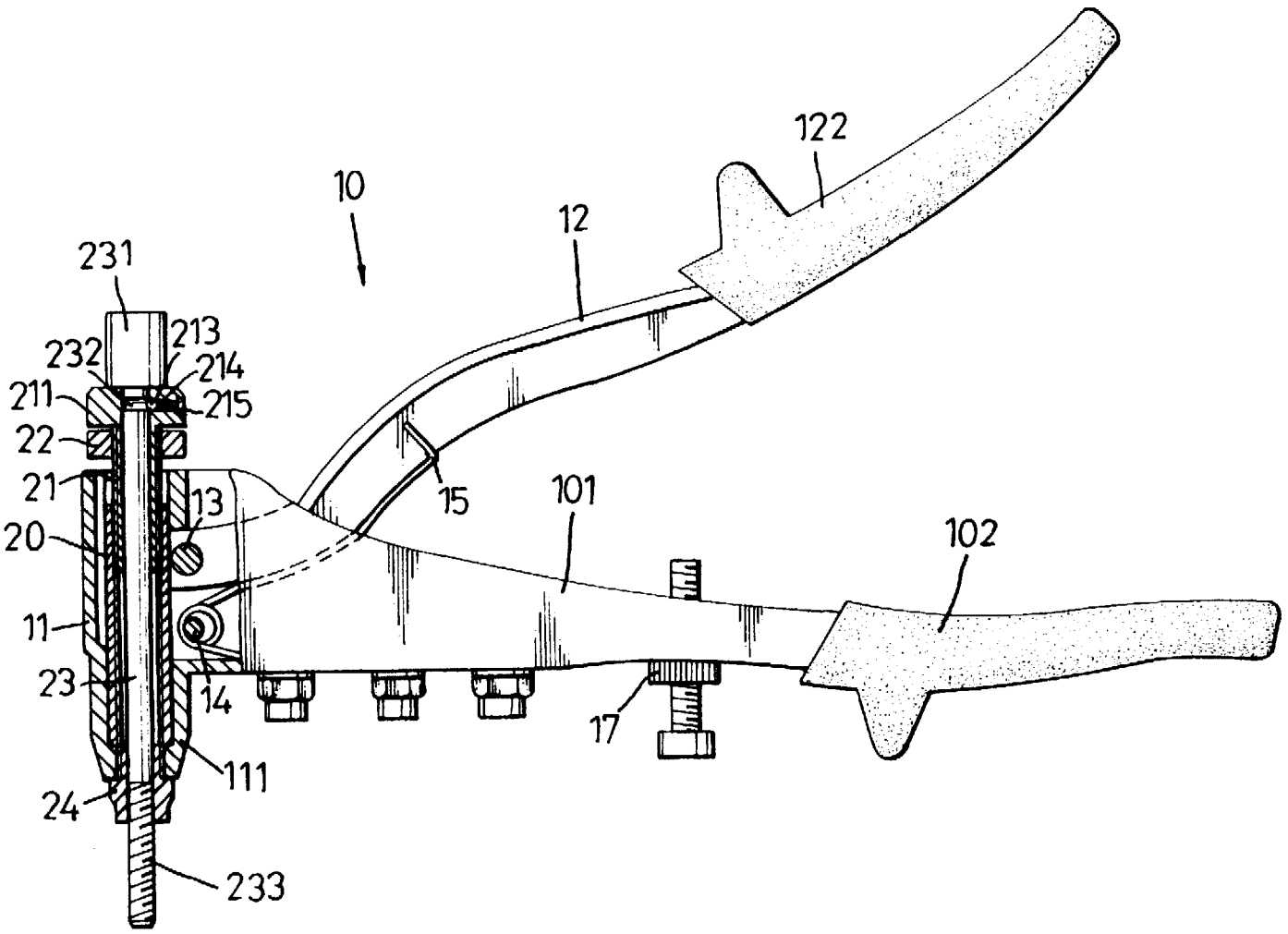
FIG. 2 is a front, partially cross-sectional view showing the tool in an assembled state.

A left end of the upper handle 12 of FIG. 2 is fixedly connected with the collet case 20 so that when the upper handle 12 is pushed downwardly toward the lower handle 101, the collet case 20 can have an upward movement.

An adjusting knob 211 is formed on a right end of the adjusting collar 21 of FIG. 1. A tapered hole 212 is defined in a periphery of the adjusting knob 211. The tapered hole 212 radially extends into an inside of the adjusting collar 21. A steel ball 213, a helical spring 214 and a screw 215 are sequentially mounted in the tapered hole 211, in which the helical spring 214 pushes the steel ball 213 so that it has a portion protruding out of an inner wall of the adjusting knob 211 of the adjusting collar 21 (better seen in FIG. 2).

The mandrel 23 is formed to have a mandrel knob 231, a groove 232 near the mandrel knob 231 and a threaded portion 233 distal to the mandrel knob 231. The mandrel 23 is connected with the adjusting collar 21 by an engagement between the steel ball 213 and the groove 232 so that the mandrel 23 can have a rotating movement relative to the adjusting collar 21. Furthermore, when a large pulling force is applied to the mandrel knob 231 of the mandrel 23, the engagement between the groove 232 and the steel ball 213 can be released so that the mandrel 23 can be pulled out of the tool 10 and replaced by another one with a different thread size for fastening a different size of rivet nut. The tool 10 in accordance with the present invention does not need any specially-designed wrench to mount/dismount the mandrel 23 to/from the tool 10. Furthermore, to replace the mandrel 23 all the operator has to do is just to pull the original one out of the tool 10 and insert another one. Thus, the present invention is more convenient to operate than the prior art hand rivet nut tool.

The groove 232 and the steel ball 213 are so positioned and dimensioned that when they are engaged together, a top face of the adjusting knob 211 of the adjusting collar 21 closely abuts on a bottom face of the mandrel knob 231 of the mandrel 23 of FIG. 2, whereby when the adjusting collar 21 is moved upwardly by pushing the upper handle 12 toward the lower handle 101, the adjusting knob 211 of the adjusting collar 21 will push upwardly the mandrel knob 231 of the mandrel 23 so that the mandrel 23 can also have an upward movement.

Figure 3:
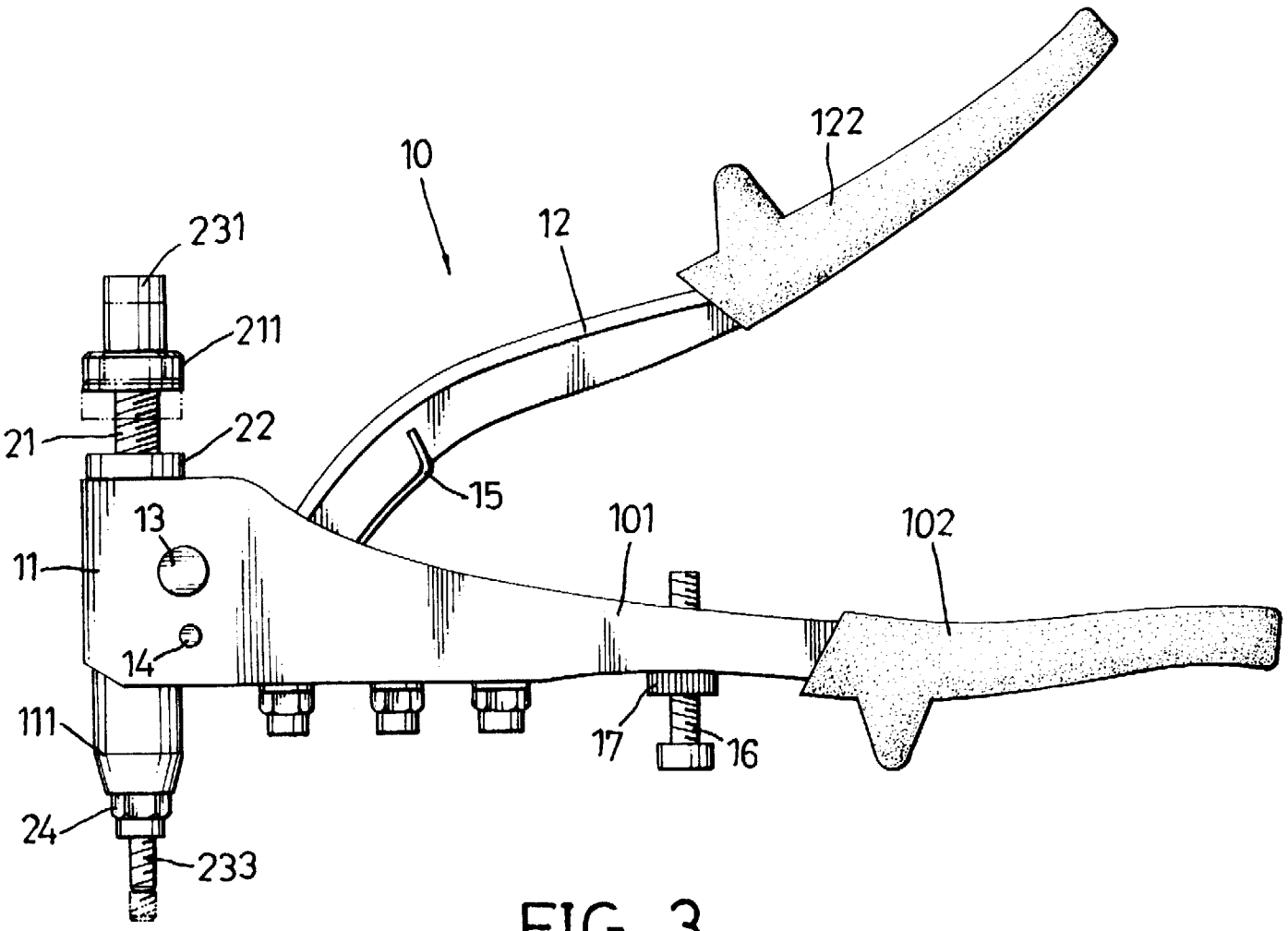
FIG. 3 is front view similar to FIG. 2 but with phantom lines showing that the positions of a mandrel and an adjusting collar are changed.

By rotating the adjusting collar 21 relative to the collet case 20, the position of the adjusting collar 21 can be adjusted whereby the position of the mandrel 23 can be also adjusted (as better seen in FIG. 3). By adjusting the position of the mandrel 23, the length of the threaded portion 233 protruding from the nosepiece 24 can be adjusted to meet the different configurations of different rivet nuts whose threaded portions for engaging with the threaded portion 233 of the mandrel 23 may have different lengths.

Figure 4:
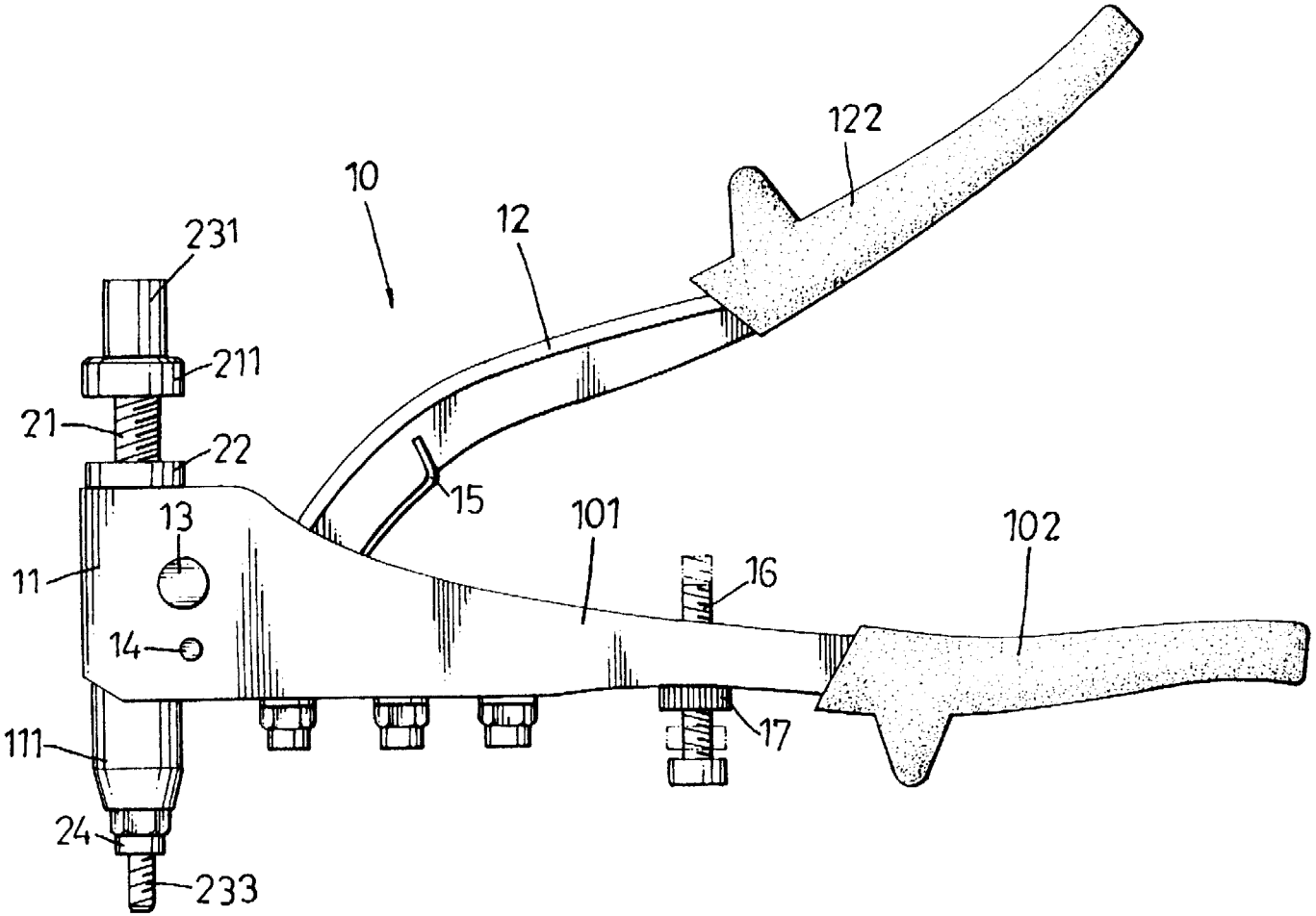
FIG. 4 is a view similar to FIG. 3 but with phantom lines showing that the position of a stroke-adjusting bolt is changed.

After the length of the threaded portion 233 of the mandrel 23 protruding from the nosepiece 24 has been adjusted to meet a specific size of the rivet nut, such a length can be fixed by turning the lock nut 22 downwardly to tightly engage with a top face of the body 11 as viewed from FIG. 4 to exert a pulling force on the adjusting collar 21 relative to the collect case 20, whereby the rotation of the adjusting collar 21 relative collect case 20 is prevented so that the length of the threaded portion 233 of the mandrel 23 protruding from the nosepiece 24 is fixed.

Figure 5:
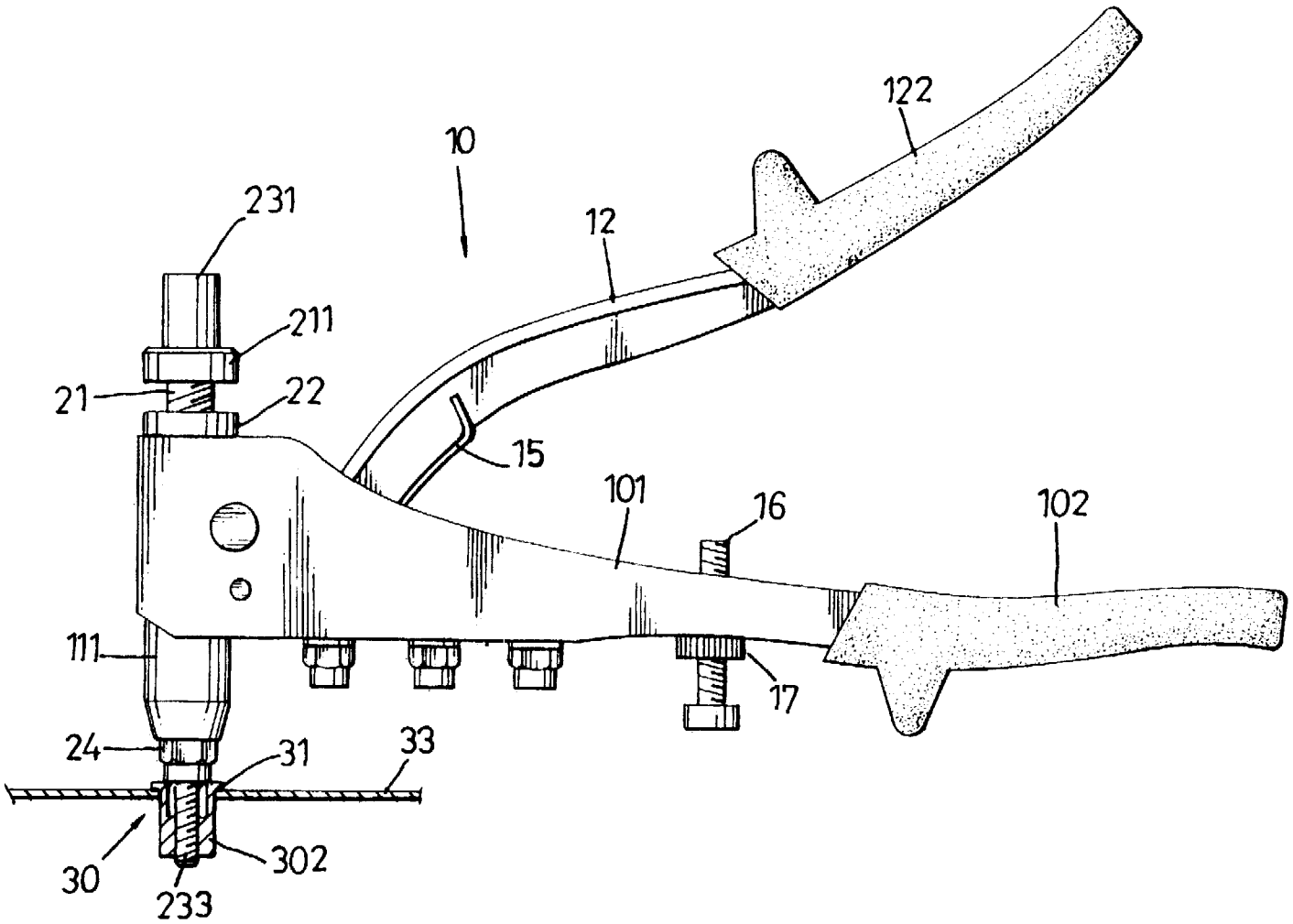
FIG. 5 is a view similar FIG. 3 but with a rivet nut being screwed onto a threaded portion of the mandrel and inserted into a prepared hole of a thin base metal to be fastened.
Figure 6:
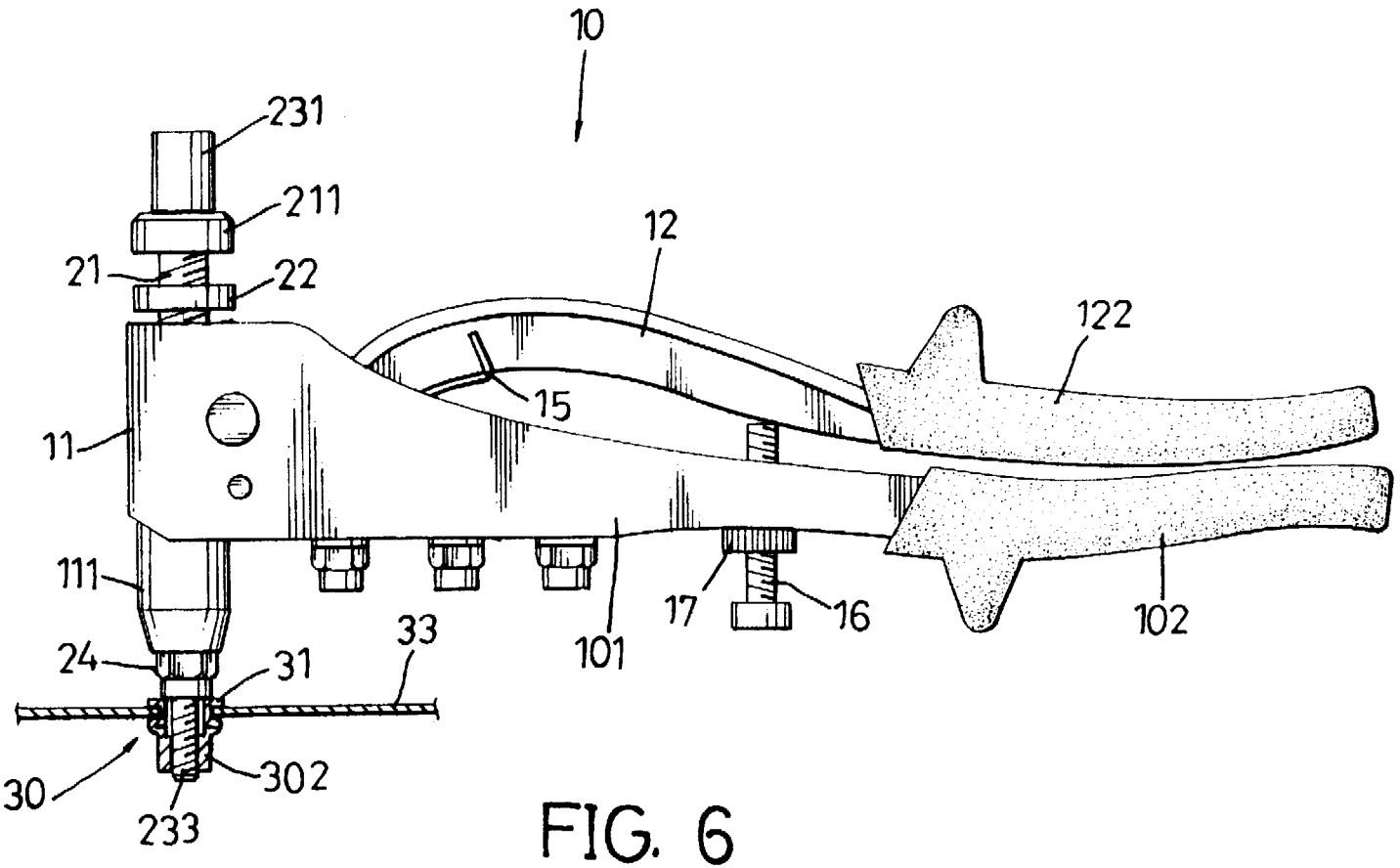
FIG. 6 is a view similar to FIG. 5 but with an upper handle being pushed downwardly to deform the rivet nut by forming a bulge against a back of the thin base metal to build up secure threading in the thin base metal.
Figure 7:
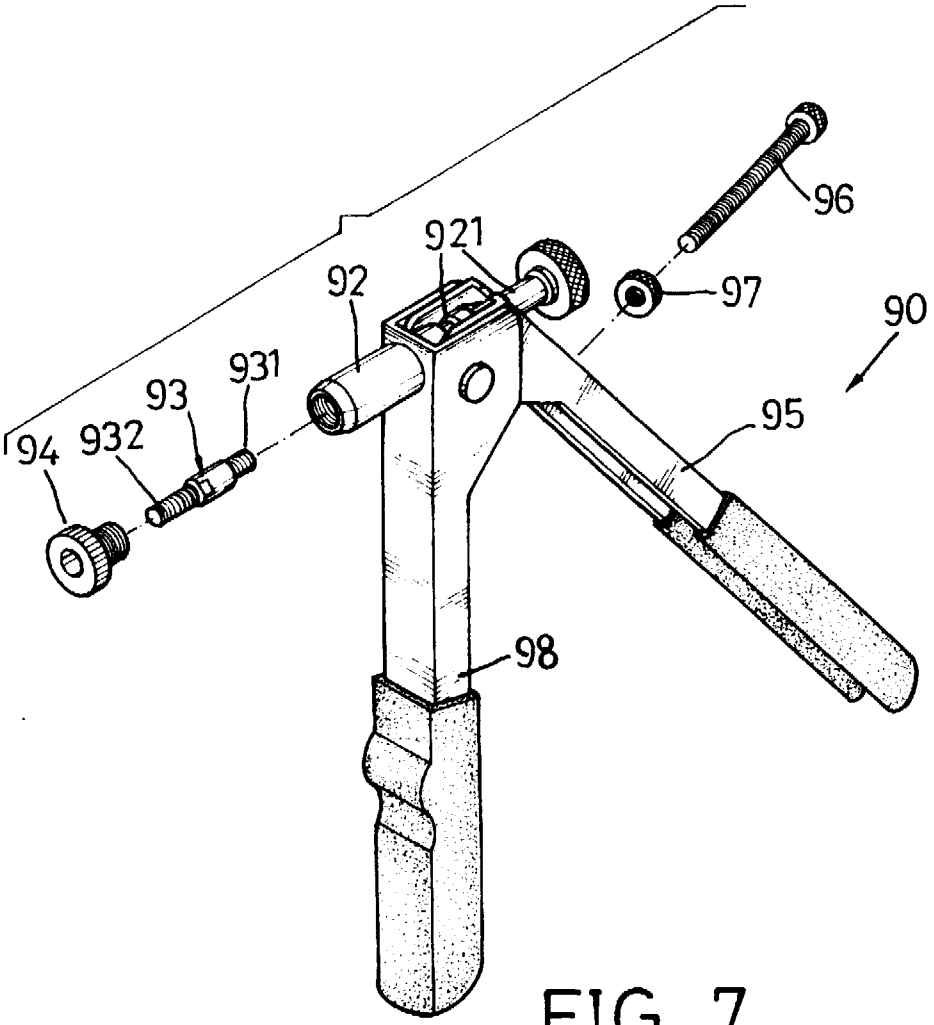
FIG. 7 PRIOR ART
FIG. 7 is a view similar to FIG. 1 but showing a prior art hand rivet nut tool.

Refer to FIGS. 5 and 6 which show how the tool 10 in accordance with the present invention is used to apply a rivet nut 30 to a thin base metal 33 and to build up secure threading in the thin base metal 33.

When the tool 10 is to be used, firstly, the threaded portion 233 of the mandrel 23 is adjusted to have a length the same as that of the rivet nut 30 to be fastened and the lock nut 22 is turned down to firmly fix the position of the mandrel 23 and then the threaded portion 233 of the mandrel 23 is brought to threadedly engage with a lower, threaded portion 302 of the rivet nut 30 by rotating the mandrel knob 231 to reach a position where a top face of a flange 31 of the rivet nut 30 touches the nosepiece 14. Then, the rivet nut 30 is brought to extend into a prepared hole in the thin base metal 33 in which a lower face of the flange 31 is in contact with the thin base metal 33, as shown by FIG. 5. Thereafter, a pushing force is exerted to the upper handle 12 toward the lower handle 101 to cause the mandrel 23 to have an upward movement, which in turn causes the threaded portion 233 to exert a compressing force on the rivet nut 30. The compressing force will deform the rivet nut 30 by forming a bulge against a bottom face of the thin base metal 33. When the rivet nut 30 is suitably deformed and the secure threading is therefore built up in the thin base metal 33, the stroke-adjusting bolt 16 is rotated toward the upper handle 12 until it is in contact with the upper handle 12 as shown by FIG. 6, whereby the stroke for the rivet nut 30 of this size is set. Finally, the pushing force on the handle 12 is released and the mandrel knob 231 of the mandrel 23 is rotated until the threaded engagement between the threaded portion 233 of the mandrel 23 and the lower, threaded portion 302 of the rivet nut 30 is released. Thereafter, the threaded portion 233 of the mandrel 23 can be brought to engage with another rivet nut 30 of the same size to repeat the above fastening operation in another hole of the thin base metal 33, without adjusting the length of the threaded portion 233 of the mandrel nor the stroke.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hand rivet nut tool, comprising:

a lower handle defining a first gripping portion and a body distal to the first gripping portion;

an upper handle defining a first end pivotably connected to the body and a second gripping portion distal to the first end;

a nosepiece attached to the body;

a stroke-adjusting bolt extending through the lower handle toward the upper handle;

a collet case slideably mounted in the body and fixedly connected to the first end of the upper handle;

an adjusting collar threadedly engaging with the collet case and defining an adjusting knob;

a lock nut threadedly engaging with the adjusting collar and located between the adjusting knob and the body; and a mandrel connected with the adjusting collar, extending through the adjusting collar, the collet case and the nosepiece and defining a threaded portion protruding from the nosepiece and a mandrel knob distal to the threaded portion and in contact with the adjusting knob, wherein said mandrel is so connected to the adjusting collar that it is rotatable relative to the adjusting collar and when a large pulling force is exerted on the mandrel knob, the connection between the mandrel and the adjusting collar may be released.

2. The hand rivet nut tool in accordance with claim 1, wherein the mandrel defines a groove and the adjusting knob defines a tapered hole and comprises a steel ball, a helical spring and a screw subsequentially received in the tapered hole, said steel ball having a portion protruding from an inner wall of the adjusting knob of the adjusting collar and engaging with the groove of the mandrel.

3. The hand rivet nut tool in accordance with claim 1 further comprising a stroke lock-nut threadedly engaging with the stroke-adjusting bolt and located between the stroke-adjusting bolt and the lower handle.

4. The hand rivet nut tool in accordance with claim 1 further comprising a plurality of spare nosepieces attached to the lower handle.

5. The hand rivet nut tool in accordance with claim 1, wherein the upper handle is pivotably connected to the body by a fulcrum pin fixedly extended through the body.

6. The hand rivet nut tool in accordance with claim 1 further comprising a torsion spring pin fixedly extended through the body and a torsion spring mounted on the torsion spring pin, said torsion spring having a first arm fastened to the body and a second arm fastened to the upper handle.

7. The hand rivet nut tool in accordance with claim 1, wherein the body is integrally formed with a protrusion and the nosepiece is threadedly engaged with the protrusion.

* * * * *